US005446636A

United States Patent [19]

Huang

[11] Patent Number: 5,446,636

[45] Date of Patent: Aug. 29, 1995

[54] LIGHT FIXTURE WITH IMPROVED HEAT DISSIPATION CHARACTERISTICS

[75] Inventor: Wenlue Huang, Miami, Fla.

[73] Assignee: Galaxy Electrical Mfg., Inc., Miami, Fla.

[21] Appl. No.: 193,541

[22] Filed: Feb. 7, 1994

[51] Int. Cl.[6] ..... F21V 29/00

[52] U.S. Cl. ..... 362/294; 362/345; 362/373

[58] Field of Search ..... 362/294, 345, 373, 431

[56] References Cited

U.S. PATENT DOCUMENTS 3,388,249 6/1968 Siegel et al. ..... 362/345
4,152,757 5/1979 Bilson et al. ..... 362/431
4,302,801 11/1981 Duddy ..... 362/345
5,183,328 2/1993 Osteen ..... 362/345
5,329,438 7/1994 Thompson ..... 362/431

*Primary Examiner*—Richard R. Cole
*Attorney, Agent, or Firm*—Rothwell, Figg, Ernst & Kurz

[57] ABSTRACT

A light fixture including an upper housing member and a reflector attached to the housing member. The reflector is formed with first and second spaced surfaces at an upper portion thereof and vent openings are provided between the surfaces. The vent openings provide improved heat dissipation from the interior of the reflector which increases the life of the light bulb. A sealing plate is provided for engaging a support arm that extends away from the upper housing member to enclose the contents thereof from the elements.

13 Claims, 4 Drawing Sheets

LIGHT FIXTURE WITH IMPROVED HEAT DISSIPATION CHARACTERISTICS

BACKGROUND OF THE INVENTION

1. Field of the Invention

The present invention relates generally to light fixtures and, more specifically, to light fixtures having a reflector with openings for venting heat that builds up inside the fixture.

2. Description of the Relevant Art

Light fixtures utilizing mercury vapor or high pressure sodium lamps or the like are known in the art. One of the foremost problems with such lights or lamps is adequately dissipating the extreme heat that builds up within the fixture. These light fixtures typically include an upper housing member which is somewhat dome-shaped and has a hollow interior. A reflector is positioned beneath the housing member and secured thereto. The housing member and the reflector cooperate to dissipate heat from the light. Light fixtures such as those described above are disclosed in U.S. Pat. Nos. 4,595,971 and 4,905,132.

The housing member typically has a support arm formed integrally therewith which extends outwardly from the housing. The reflector disclosed in the U.S. Pat. No. 4,595,971 patent has an upper surface with several spaced vent openings formed therein. The lower edge of the housing member overlies the openings in the reflector when the fixture is assembled. This arrangement diverts heat from the interior of the reflector, through the slots, and past the lower edge of the housing to the atmosphere. However, the limited dissipation achieved by the light fixture disclosed in the U.S. Pat. No. 4,595,971 patent causes problems as discussed above.

The light fixture disclosed in the aforementioned U.S. Pat. No. 4,905,132 patent has a support arm that is used to dissipate heat. A specially formed enclosure plate blocks the passage of heat from the reflector's interior to the housing member, instead directing the heat from the reflector through the support arm. The heat from the lamp escapes through the support arm and not into the interior of the housing member.

However, the reflector disclosed in the U.S. Pat. No. 4,595,971 patent has only one opening through which heat can escape. Accordingly, heat and pressure build up within the fixture and can adversely affect the lamp's performance as well as the life of the bulb. In addition, the reflector and enclosure plate utilize a substantial amount of material which results in increased manufacturing cost.

Accordingly, there is a need in the art for a light fixture that is free of the problems of the prior art.

SUMMARY OF THE INVENTION

The present invention provides a light fixture with improved heat dissipation. The fixture includes a reflector attached to an upper housing member. The reflector includes vent openings through which heat dissipates into the upper housing and the support arm that is formed integrally with the housing.

The reflector includes at its upper end first and second spaced surfaces. The vent openings are disposed between the first and second surfaces. Heat dissipates through the vent openings into the upper housing member and into the support arm.

The lamp holder (i.e., light socket) and ballast are preferably secured to a bracket member that is affixed to the upper housing member. The reflector is secured to the bracket member at one of the aforementioned spaced surfaces. The upper housing member preferably has shoulders or platforms which abut the other surface of the reflector to provide stability when the fixture is assembled.

A sealing plate is provided for engaging the underside of the U-shaped support arm to enclose and seal the contents thereof, e.g. electrical wiring. The sealing plate includes a vertical plate which substantially blocks the opening at the juncture of the support arm and the interior of the housing member. This vertical plate has an opening for electrical wiring which permits heat to dissipate from the interior of the reflector through the support arm.

BRIEF DESCRIPTION OF THE DRAWINGS

Other aspects, features and advantages of the present invention will be apparent from the following detailed description of a preferred embodiment taken in conjunction with the accompanying drawings, wherein.

DETAILED DESCRIPTION OF THE PREFERRED EMBODIMENTS

Figure 1:
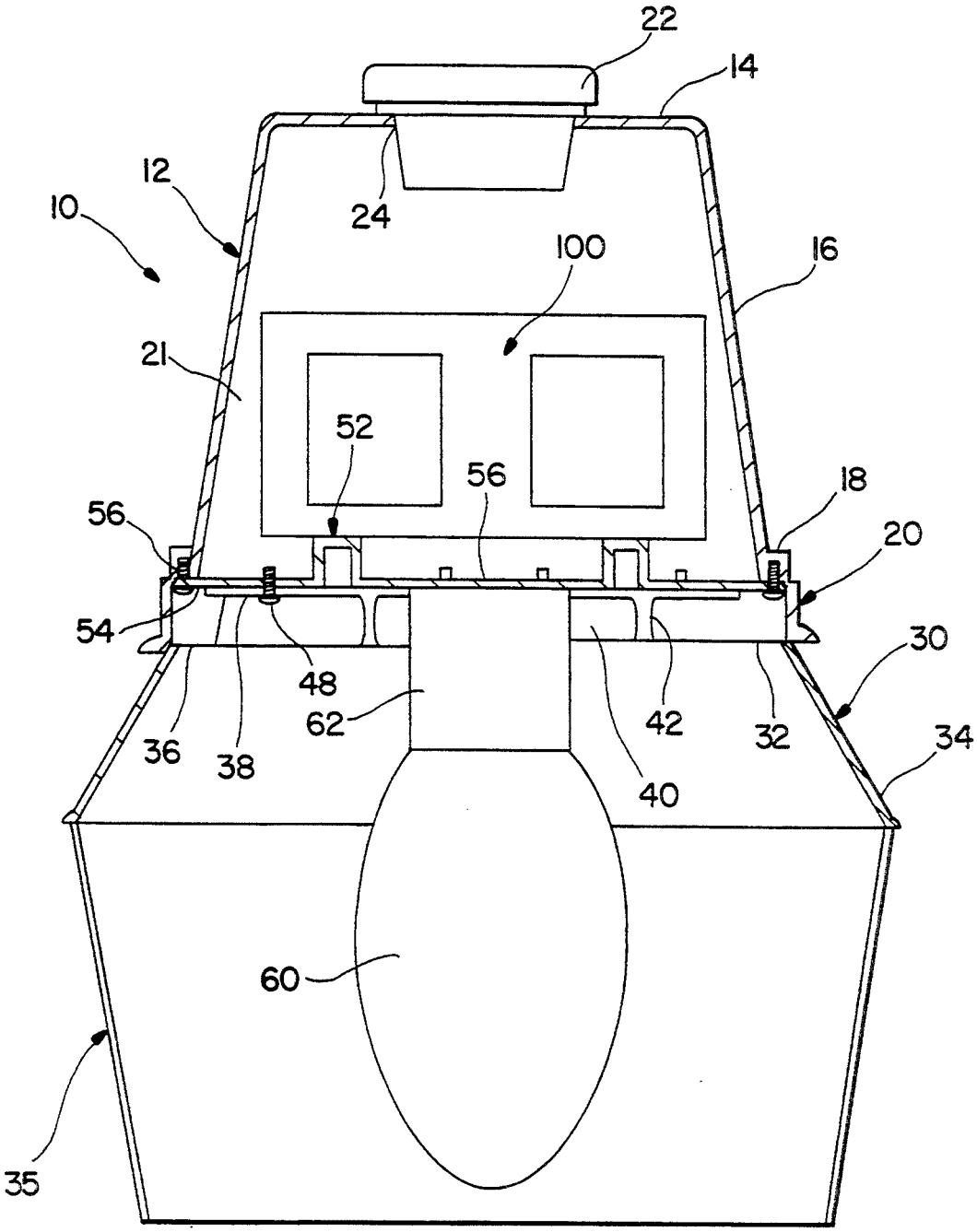
FIG. 1 is a partial sectional view of a light fixture according to the present invention.

A light fixture according to the present invention is indicated generally by the reference numeral 10 in FIG. 1. The fixture 10 includes an upper housing member 12 and a reflector 30. Upper housing member 12 is similar to that disclosed in the aforementioned U.S. Pat. Nos. 4,595,971 and 4,905,971, the subject matter of which patents is incorporated by reference into the present application.

Upper housing member 12 has a top portion 14 which preferably has a photocell 22 disposed therein for controlling operation of the light fixture. A side wall 16 extends from top portion 14 and is slightly flared with respect thereto. The top portion 14 and side wall 16 define the interior chamber 21 of housing member 12. A flange 20 is formed at the end of housing member 12 opposite top portion 14 and is configured to engage the reflector 30 as will be described below. Flange 20 is provided with one or more mounting portions 18 for supporting a bracket member 50 to which reflector 30 is attached. The interior of the housing member 12 encloses a ballast 100 as is known in the art.

Figure 6:
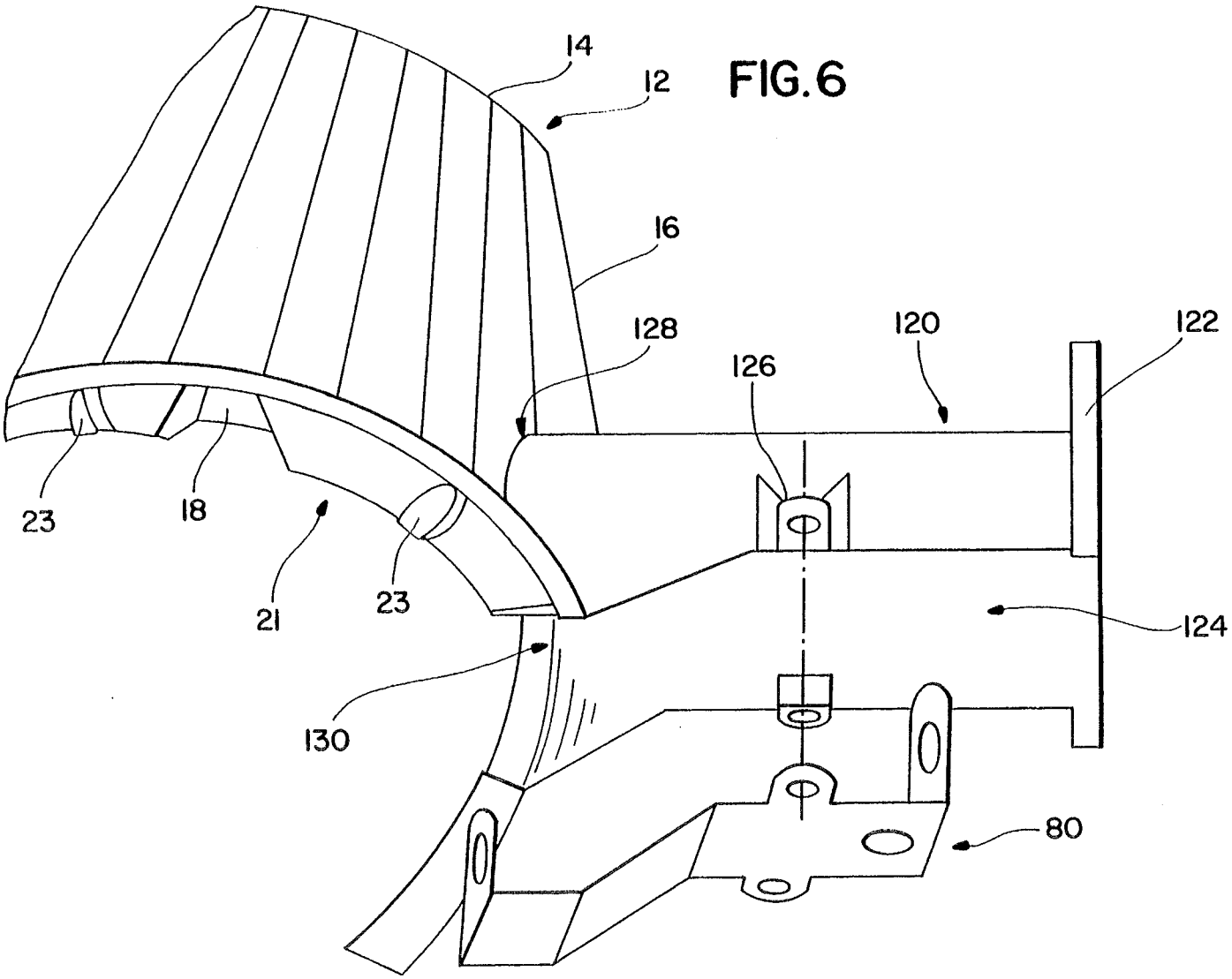
FIG. 6 is a perspective exploded view of the upper housing member and sealing plate of the light fixture shown in FIG. 1.

As seen in FIG. 6, housing 12 has a support arm 120 formed integrally therewith and extending outwardly therefrom at juncture 128. Support arm 120 has a base 122 for attaching the light fixture 10 to a suitable support surface as is known in the art. Support arm 120 is in the form of an inverted U-shaped channel with an interior 124 which is closed off by a sealing plate 80 as will be described below. Mounting elements 126 are formed on the support arm 120 for securing the sealing plate 80 to the latter. The interior 21 of upper housing member 12 communicates with the interior 124 of support arm 120 through opening 130 located at juncture 128.

Figure 2:
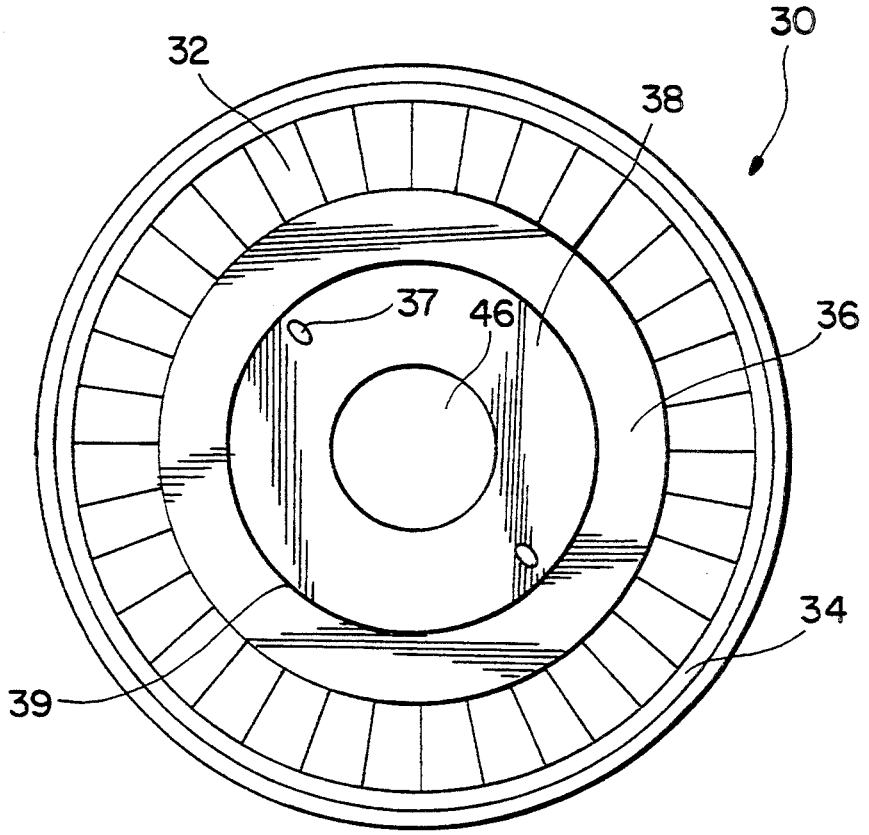
FIG. 2 is a plan view of the reflector that forms part of the light fixture shown in FIG. 1.
Figure 3:
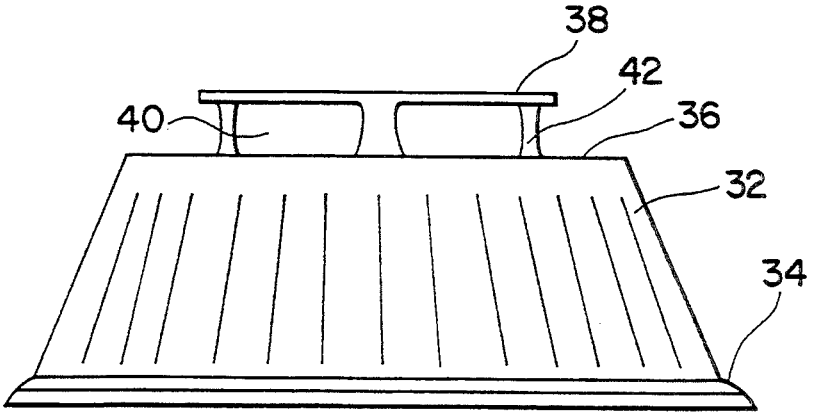
FIG. 3 is a front elevational view of the reflector of FIG. 2.

Reflector 30, shown in FIGS. 1–3, is in the form of a hollow bowl-shaped member and includes an upper portion 32 and a lower edge portion 34. The lower edge portion 34 of reflector 30 is configured for attachment to a refractor 35 as is known in the art. For example, the lower edge 34 can be rolled over an upper edge of the refractor 35 as disclosed in the aforementioned patents.

Upper portion 32 of reflector 30 includes a first surface 36 and a second surface 38. Surfaces 36, 38 are preferably circularly-shaped planar surfaces spaced from each other as seen in FIG. 3. One or more web members 42 extend between the surfaces 36, 38 to define the spacing therebetween. Vent openings 40 are defined in the spacing between surfaces 36, 38 (and between web members 42) and form pathways for heat to dissipate from the interior of the reflector. First surface 36 has a central opening 44 in which a light bulb 60 is positioned. Second surface 38 has a central opening 46 through which the bulb 60 passes as well.

First surface 36 is preferably a flat circular annular surface with opening 44 defined by the inner edge of surface 36. Second surface 38 also is preferably a flat circular surface with the opening 46 defined by the inner edge of surface 38. The outer peripheral edge 39 of second surface 38 substantially overlies the aforementioned inner edge of first surface 36. In the preferred embodiment, web members 42 extend upwardly from the inner edge of first surface 36 to the outer periphery of second surface 38 with vent openings 40 defined between adjacent web members 42. Any number of spaced web members can be used. Preferably, 3–6 web members are formed between first surface 36 and second surface 38.

Referring to FIG. 1, heat dissipates upwardly from the interior of reflector 30 through the opening 44 defined by first surface 36. The heat passes through vent openings 40 into the interior 21 of upper housing member 12. The present invention achieves improved heat dissipation characteristics due in part to the vent openings 40 which provide a number of pathways for heat to escape.

The reflector 30 is affixed to upper housing member 12 by means of a bracket member 50. Bracket 50 is shown in FIG. 1 and is similar to the mounting brackets shown in the aforementioned patents previously incorporated herein by reference. The bracket 50 has opposite end portions 54 which are secured to the mounting portions 18 of upper housing 12 by any suitable fasteners, e.g., screws. Bracket 50 also includes a raised area 52 to which the ballast 100 is attached, for example, by being welded thereto. Light socket 62 is secured to bracket 50 at a central portion 56 of the latter.

Bracket 50 also serves to attach reflector 30 to the upper housing member 12 as seen in FIG. 1. The second surface 38 of reflector 12 preferably has apertures 37 formed therein (FIG. 2) which align with apertures in bracket 50 (not shown). Suitable fasteners such as screws 48 are passed through said respective apertures to securely attach the reflector 30 to bracket 50, which in turn is firmly affixed to upper housing member 12. The lower flange 20 of upper housing member 12 preferably has a plurality of support platforms 21 which engage the first surface 36 of reflector 30 to provide a stable secure assembly. See FIG. 6.

Figure 5:
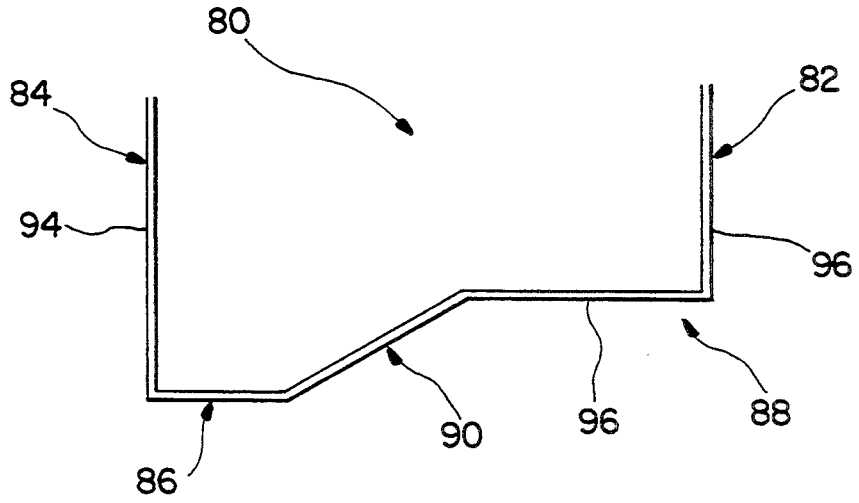
FIG. 5 is a side elevational view of the sealing plate of FIG. 4.
Figure 4:
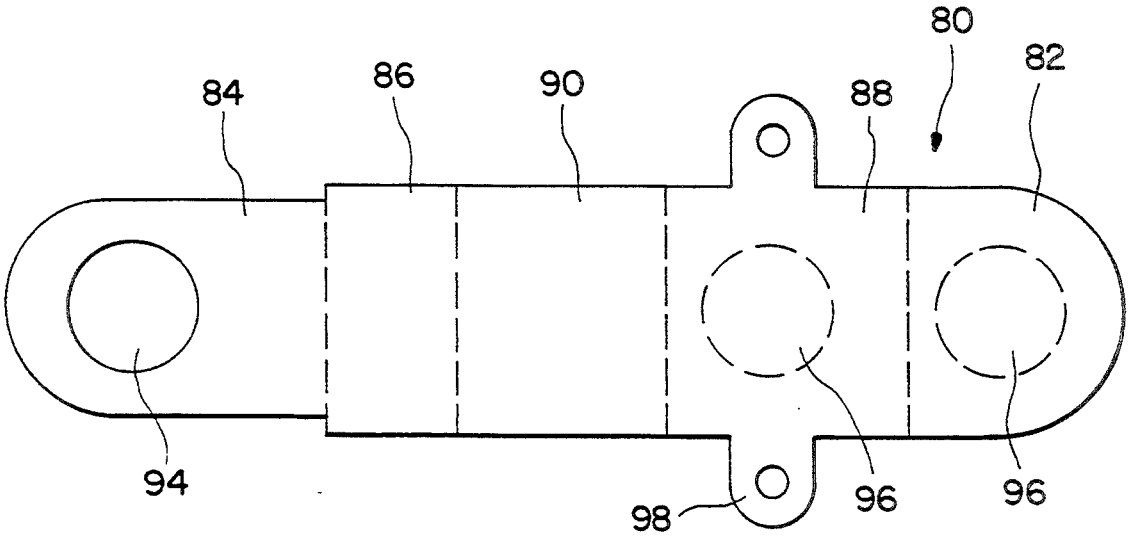
FIG. 4 is a plan view of a sealing plate for the light fixture shown in FIG. 1.

With reference to FIGS. 4 and 5, a sealing plate 80 is shown. Sealing plate 80 is configured for attachment to the underside of support arm 120 of housing member 12 as will be described in detail below. The plate 80 is preferably fabricated from sheet metal or the like and is formed as shown in FIG. 5. Vertical plates 82, 84 are disposed at opposite ends of sealing plate 80 and are respectively positioned in the ends of support arm 120 (FIG. 6). Horizontal portions 88, 86 respectively extend from vertical plates 82, 84 as seen in FIG. 5. An angled portion 90 is disposed between horizontal portions 86, 88. Attachment wing portions 98 are formed on sealing plate 80 for attaching same to mounting portion 126 of support arm 120.

The vertical plate 82 of sealing plate 80, which is positioned in the support arm 120 adjacent base 122 thereof, has a removable portion 96 that can be punched out or similarly removed to provide an access opening into the interior 124 of the support arm, e.g. for electrical wiring. Horizontal portion 88 of sealing plate 80 likewise has a removable portion 96 for forming an access opening. The removable portions 96 can be punched out or easily removed from the remainder of sealing plate 80 and can be defined by, for example, weakened areas, perforated areas, score lines, etc.

As seen in FIG. 5, wiring or the like is passed into support arm 120 through the bottom thereof if the access opening in horizontal portion 88 is used. If the access opening in vertical plate 82 is used, the wiring is passed through the base end 122 of support arm 120. The wiring is then passed through opening 94 in vertical plate 84 to the interior of upper housing member 12. The removable portions of sealing plate 80 allow one to select which access opening 96 will be used. The unused access opening portion is left intact so as to seal the contents of support arm 120 from the elements.

Turning now to FIG. 6, sealing plate 80 and upper housing 12 with support arm 120 are shown in exploded fashion. Sealing plate 80 is positioned against the underside of support arm 120 and secured thereto as discussed above. Vertical plate 84 is positioned in the opening 130 defined at the juncture 128 of the support arm 120 and upper housing member 12. As mentioned above, vertical plate 84 has opening 94 therein through which wiring can pass. Heat passes through vent openings 40 of reflector 30 to the upper housing interior 21 as described above, and through aperture 94 of vertical plate 84 to provide increased dissipation as compared with prior art lighting fixtures.

It is readily apparent that the light fixture of the present invention provides increased pathways that allow heat to dissipate from the interior of the reflector. Consequently, the reduced heat within the reflector of the present invention increases the useful life of the light bulb and prevents rapid againg of the plastic shade or refractor. Moreover, the overall performance of the lamp is enhanced because the efficiency of the device is higher when the interior temperature is cooler. Further, the light fixture of the present invention is easier to assemble by the user than prior art light fixtures and, in addition, can be economically mass produced.

Although the present invention has been described with reference to particular embodiments, it is to be understood that the embodiments are merely illustrative of the application of the principles of the invention. Numerous configurations may be made therewith and other arrangements may be devised without departing from the spirit and scope of the invention.

What is claimed is:

1. A light fixture comprising:

an upper housing member having an interior chamber and a support arm extending away from said chamber, the support arm having an opening in communication with the interior chamber; and a reflector attached to said upper housing member, said reflector having a top portion which includes first and second substantially planar surfaces, said first and second surfaces being substantially parallel and spaced from each other with at least one opening disposed therebetween, said at least one opening providing a vent for the escape of heat from an interior of said reflector.

2. A light fixture according to claim 1, wherein said first and second surfaces are joined by a plurality of web members so as to form a plurality of vent openings.

3. A light fixture according to claim 1, wherein said second surface is disposed above said first surface so as to be axially spaced therefrom.

4. A light fixture according to claim 3, wherein said second surface has means for attaching the reflector to a bracket that is secured to said upper housing member.

5. A light fixture according to claim 3, wherein said second surface has an outer peripheral edge which is spaced inwardly from an outer peripheral edge of said first surface.

6. A light fixture according to claim 5, wherein a plurality of vent openings are provided, and said plurality of vent openings are disposed adjacent substantially the entire periphery of the second surface.

7. A light fixture according to claim 1, further comprising a sealing plate attached to an underside of said support arm, the sealing plate including a first vertical plate at one end thereof which blocks said opening to the interior chamber of the upper housing member except for an aperture formed in said first vertical plate.

8. A light fixture according to claim 7, wherein the sealing plate has a second vertical plate at an opposite end thereof and a flat horizontal portion connected to the second vertical plate, said flat horizontal portion and said second vertical plate each having a removable portion for selectively forming an access opening into the interior of said support arm.

9. A light fixture comprising:

a housing member having an interior and an external surface with a support arm joined to and extending away from the external surface, said housing member including a lower edge;

a reflector attachable to said housing member, the reflector having an upper portion and first and second surfaces defining at least one vent opening therebetween adjacent the upper portion of said reflector; and wherein said reflector first surface engages means for attaching the reflector to the housing member and said reflector second surface abuts the lower edge of said housing member when the housing member and reflector are attached.

10. A light fixture according to claim 9, further including support platforms formed on said upper housing member near the lower edge thereof for abutting the second surface of the reflector.

11. A light fixture according to claim 9, wherein said first and second reflector surfaces are spaced in an axial direction and the vent openings are defined between said first and second surfaces.

12. A light fixture comprising:

an upper housing member having an interior chamber and a support arm extending away from said chamber, the support arm having an opening in communication with the interior chamber;

a reflector attached to said upper housing member, said reflector having a top portion which includes first and second substantially planar surfaces, said first and second surfaces being spaced from each other with at least one opening disposed therebetween, said at least one opening providing a vent for the escape of heat from an interior of said reflector; and a sealing plate attached to an underside of said support arm, the sealing plate including a first vertical plate at one end thereof which blocks the opening to the interior chamber of the upper housing member except for an aperture formed in said first vertical plate.

13. A light fixture according to claim 12, wherein the sealing plate has a second vertical plate at an opposite end thereof and a flat horizontal portion connected to the second vertical plate, the flat horizontal portion and the second vertical plate each having a removable portion for forming an opening which provides access into the interior of said support arm.

* * * * *